US005293748A

United States Patent [19]

Flanigan

[11] Patent Number: 5,293,748

[45] Date of Patent: Mar. 15, 1994

[54] PISTON CYLINDER ARRANGEMENT FOR AN INTEGRAL STIRLING CRYOCOOLER

[75] Inventor: Paul J. Flanigan, Clay, N.Y.

[73] Assignee: Carrier Corporation, Syracuse, N.Y.

[21] Appl. No.: 550,589

[22] Filed: Jul. 10, 1990

[51] Int. Cl.[5] ..... F25B 9/00

[52] U.S. Cl. ..... 62/6; 60/517

[58] Field of Search ..... 60/517; 62/6

[56] References Cited

U.S. PATENT DOCUMENTS 3,667,348 6/1972 Neelen ..... 60/517 X 4,381,648 5/1983 Balas, Jr. ..... 60/517

*Primary Examiner*—Charles T. Jordan

[57] ABSTRACT

The guide portion of the cylinder of a Stirling cycle device is located at least partially within and is axially coextensive with the bellows thereby providing a reduction in the height/length of the piston, cylinder and bellows assemblies. The reduction is the distance between the guide surface and the top of the piston reduces the moment arm for canting.

9 Claims, 6 Drawing Sheets

PISTON CYLINDER ARRANGEMENT FOR AN INTEGRAL STIRLING CRYOCOOLER

BACKGROUND OF THE INVENTION

As is well known, Stirling cycle cryogenic refrigerators, or cryocoolers, use a motor driven compressor to impart a cyclical volume variation in a working volume filled with pressurized refrigeration gas. The pressurized refrigeration gas is fed from the working volume to one end of a sealed cylinder called a cold head. An annular heat exchanger or regenerator is positioned inside the cold head. The regenerator has openings in either end to allow the refrigeration gas to enter and exit.

The compressor and expander reciprocate in a fixed relationship creating the volume variations in the working space and forcing the refrigeration gas to flow through the regenerator in alternating directions. One end of the regenerator is above ambient temperature during operation while the other end is at a cryogenic temperature. Gas enters the expander at cryogenic temperature and as the gas expands it absorbs heat, ideally, at constant temperature. The device to be cooled is mounted adjacent the expansion space, on the cold end of the cold head.

Because the cold head is sealed, the volume of the expansion space also varies as the expander reciprocates. The efficiency of a Stirling cryocooler is optimized by properly timing the movement of the expander. Specifically, its movement should be such that the variations in the volume of the expansion space lead the variations in the volume of the compression space by approximately 90°. This insures that The working volume's pressure and temperature are at a peak before the refrigeration gas enters the regenerator from the working volume.

The two most common configurations of Stirling cryocoolers are referred to as "split" and "integral". The split Stirling type has a compressor which is mechanically isolated from the expander. Cyclically varying pressurized gas is fed between the compressor and expander through a gas transfer line. In most split Stirling cryocoolers proper timing of expander movement is achieved by using precision friction seals.

In an integral Stirling cryocooler, the compressor, heat exchangers, regenerator and cold head are assembled in a common housing. The typical arrangement uses an electric motor to drive the moving parts. A crankshaft, disposed in a crankcase, is used to properly time compressor and expander movement, much as an internal combustion engine uses a crankshaft to provide proper timing of the movement of its parts. As such, the typical integral cryocooler requires several bearings to support the crankshaft. If connecting rods are used to couple the compressor and expander to the crankshaft, additional bearings are required. One problem with this arrangement is that these bearings require a lubricant. Unfortunately, lubricants are subject to freezing at cryogenic temperatures and consequently must be prevented from freezing and plugging the regenerator. Many different sealing arrangements have been used. Some Stirling systems use contact seals of the wearing type along with hydro formed bellows to prevent lubricant from reaching the regenerator. However, these arrangements produce wear particles which result in limited operating life.

One way to prevent oil containing refrigerant gas in the crankcase from reaching the oil-free refrigerant gas in the regenerator is to use a bellows seal. Bellows seals have been found to be particularly suited for this application. The bellows configurations have been stacked or axially spaced and have excessive height/length requirements.

SUMMARY OF THE INVENTION

The piston structure of the Stirling cycle device of the present invention is unusual in that the piston is made up of a seal portion and a guide portion. There are no piston rings or the like and the seal portion moves in a bore with a very small clearance but without contact between the seal portion and the bore because of the need to be free of lubricant and particles produced by wear. The length of the seal portion as well as the clearance determines the pressure drop across the seal portion. The guide portion is separated from the oil-free refrigerant by the bellows seal. The guide portion coacts with a bore to guide the movement of the piston seal. To prevent the piston from canting and permitting the seal portion to contact its bore, it is necessary to locate the guide portion in a long bore with small clearances. Because efficient operation of the cryocooler requires maintaining extremely small, critical dimensional tolerances, even the minute contaminations carried in the lubricant cause unacceptable wear of the moving parts, which in turn severely shortens operating life.

The stacked or axially spaced distribution of the conventional piston, cylinder and bellows of a conventional Stirling cycle device is replaced with a telescoping arrangement. Specifically, the guide portion of the cylinder is at least partially located within and axially coextensive with the bellows thereby providing a reduction in the height/length of the piston, cylinder and bellows assembly.

It is an object of this invention to reduce the piston, cylinder and bellows assembly height in a Stirling cycle device.

It is another object of this invention to reduce the weight of the pistons in a Stirling cycle device.

It is a further object of this invention to reduce the distance between the guide surface and the top of the piston and thereby the moment arm for canting. These objects, and others as will become apparent hereinafter, are accomplished by the present invention.

Basically, a portion of the guide portion of the cylinder is formed as an axially extending tubular portion or collar. The bellows surrounds, and is at least partially axially coextensive with the collar whereby relative movement is in the nature of a telescoping action.

BRIEF DESCRIPTION OF THE DRAWINGS

For a fuller understanding of the present invention, reference should now be made to the following detailed description thereof taken in conjunction with the accompanying drawings wherein.

DESCRIPTION OF THE PREFERRED EMBODIMENT

Figure 1:
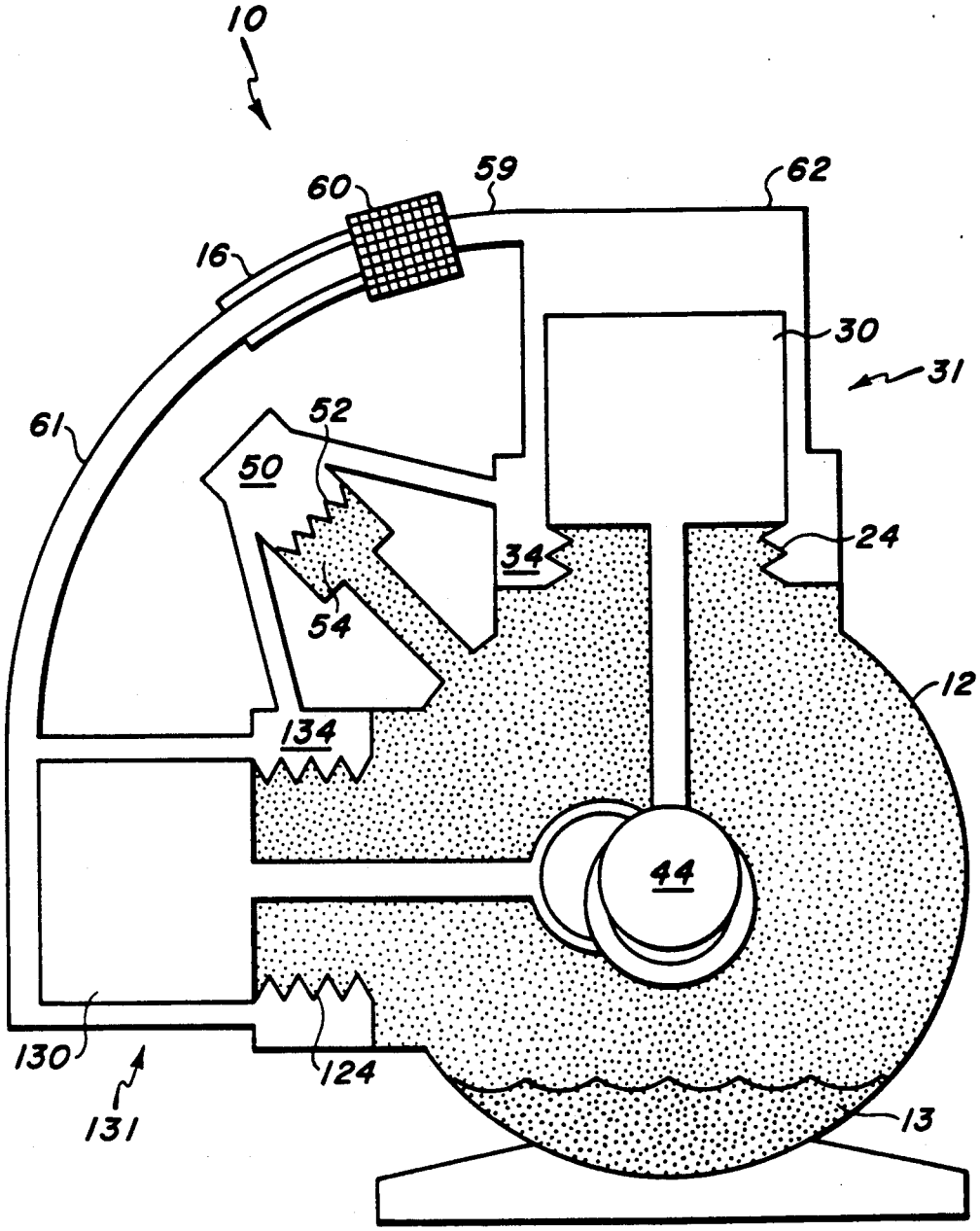
FIG. 1 is a schematic representation of a Stirling cycle device employing the present invention.

In FIGS. 1-5 the numeral 10 generally designates a Stirling cycle cryocooler having a crankcase 12. Crankcase 12 has an oil sump 13 and is filled with oil laden helium as a result of lubricating parts within crankcase 12. A motor (not illustrated) is located within crankcase 12 and via crankshaft 44 drives piston 30 of expander 31 and piston 130 of compressor 131. Referring specifically to FIG. 1, it will be noted that piston 30 is sealed with respect to crankcase 12 by bellows 24 and, similarly, piston 130 is sealed with respect to crankcase 12 by bellows 124. It will be noted that crankcase 12 and bellows 24 define a chamber 34 that is fluidly isolated from the interior of crankcase 12. Similarly, crankcase 12 and bellows 124 define a chamber 134 that is fluidly isolated from the interior of crankcase 12. Chambers 34 and 134 are, however, connected through buffer chamber 50. Buffer chamber 50 is separated from chamber 54 by diaphragm 52 and chamber 54 is in fluid communication with the interior of crankcase 12. Expander 31 and compressor 131 are connected via line 59, regenerator 60 and line 61.

The gas in regenerator 60 and in chambers 34, 50 and 134 as well as in expander 31 and compressor 131 is pure helium. In operation of the FIG. 1 system, compressor 131 is driven approximately 90° ahead of expander 31. On the discharge stroke of piston 130, helium is forced from compressor 131 through regenerator 60 for approximately 90° of rotation before expander 31 starts its suction stroke. When expander 31 starts its suction stroke, the helium expands and thereby cools providing a refrigerating effect at the cold head 62. When compressor 131 starts its suction stroke piston 30 is approximately at bottom dead center so that as expander 31 goes to the discharge stroke compressor 131 has created a pressure differential across regenerator 60 causing reverse flow through regenerator 60 from expander 31 to compressor 131. As pistons 30 and 130 reciprocate, the chambers 34 and 134 are, effectively, diaphragm pumps and chamber 50 accommodates the pressure and volume changes.

Figure 2:
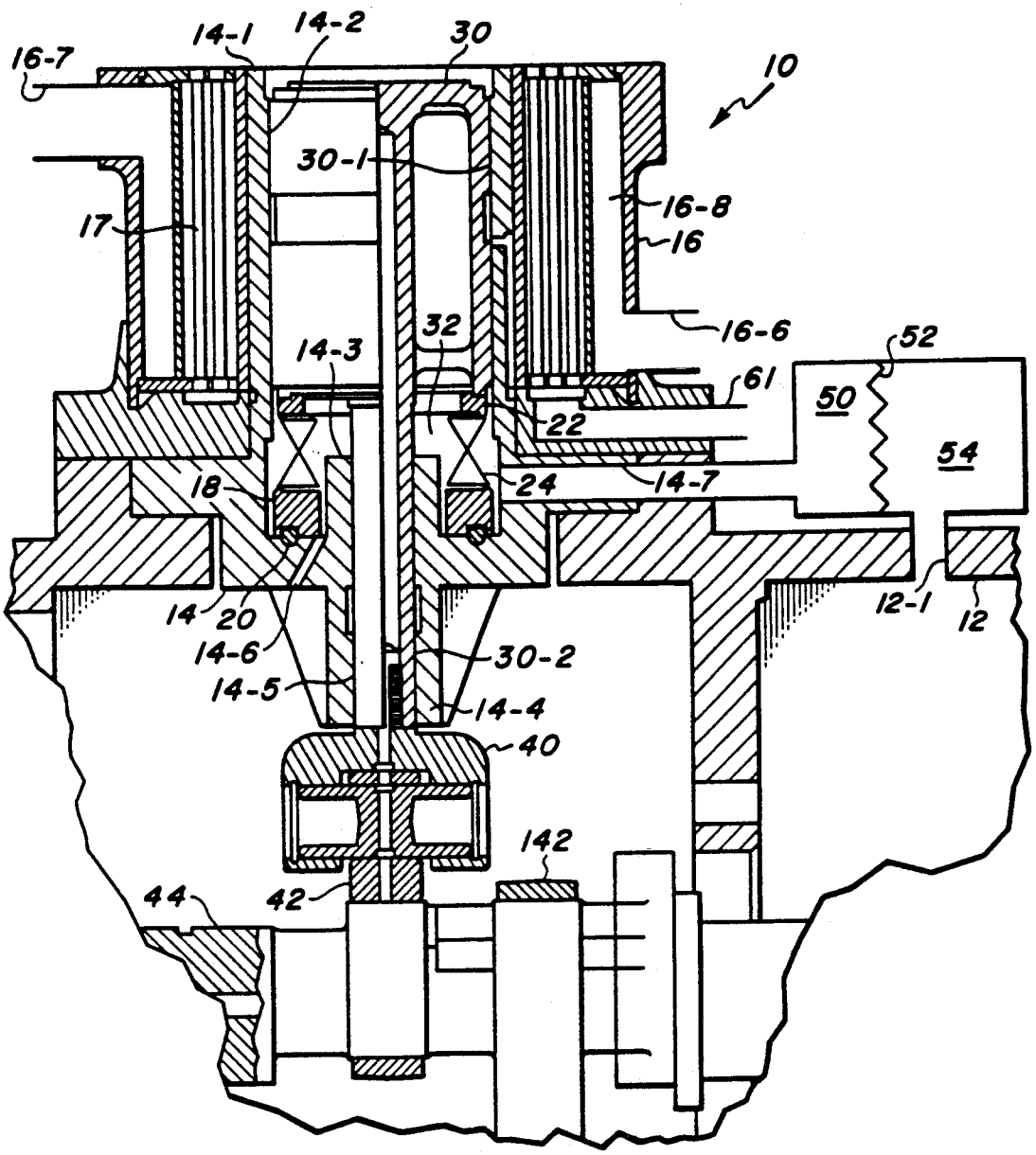
FIG. 2 is a partially sectioned view of a portion of the expander assembly of a Stirling cycle device with the piston at top dead center.
Figure 3:
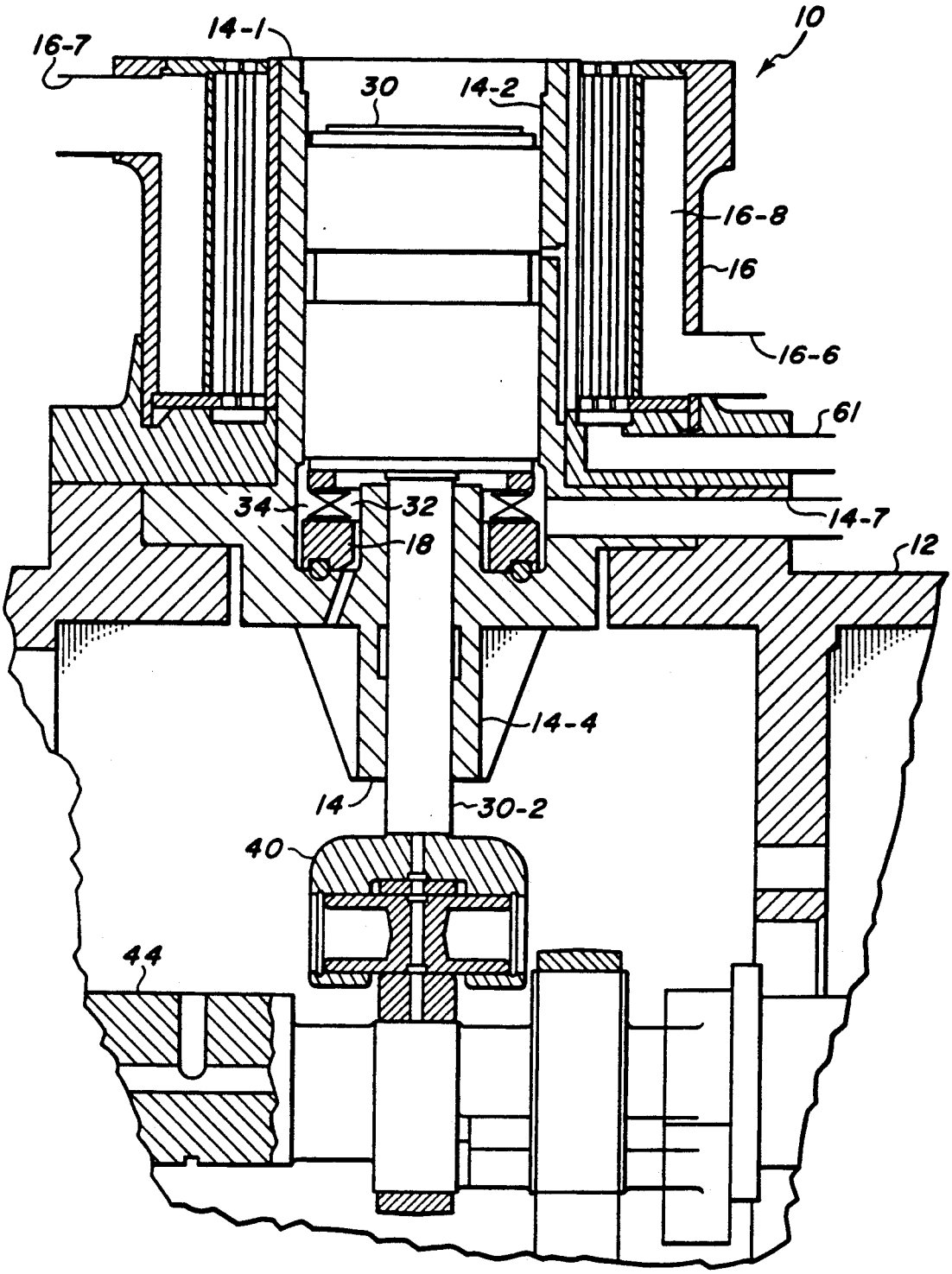
FIG. 3 is similar to FIG. 2 except that the piston is at bottom dead center.
Figure 4:
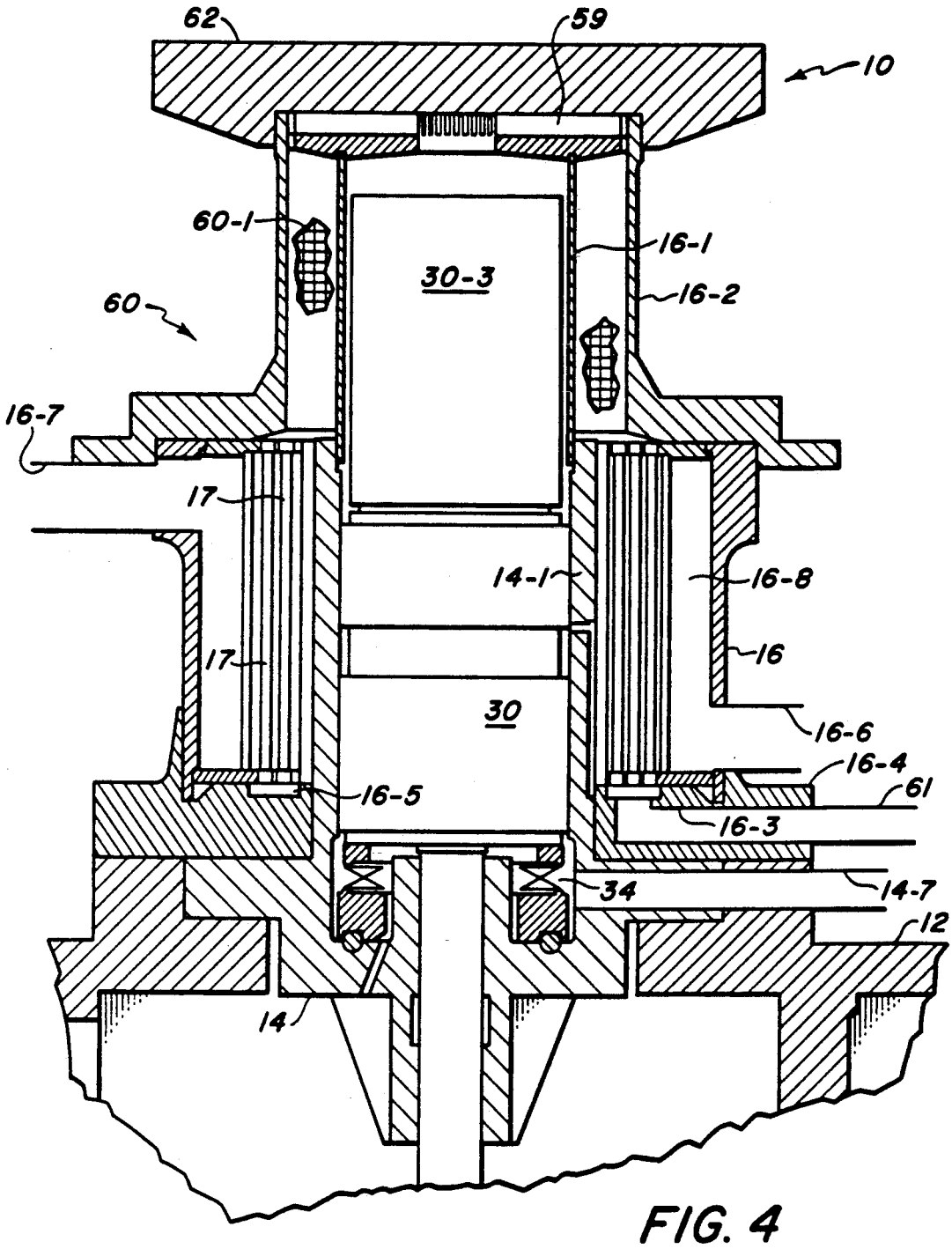
FIG. 4 is similar to FIG. 3 except that it shows additional portions of the cold head.

Referring now specifically to FIGS. 2-4 crosshead 14 is sealed and secured to crankcase 12 by bolts or other suitable structure and suitable seals (not illustrated). Crosshead 14 includes a cylindrical portion 14-1 defining a piston bore 14-2. Cylindrical portion 14-1 is received within heat exchanger 16 of the expander assembly. Crosshead 14 further includes coaxial tubular portions 14-3 and 14-4 which define bore 14-5. Annular, lower terminal 18 is suitably secured to crosshead 14 by bolts or the like and surrounds tubular portion 14-3. O ring or other suitable seal 20 provides a fluid seal between lower terminal 18 and crosshead 14. Annular bellows 24 is secured to lower terminal 18 in a suitable fluid tight manner, as by welding.

Referring specifically to FIG. 2, piston 30 includes a piston head having an annular cylindrical portion 30-1 received in bore 14-2 in a non-contacting relationship so as to define a seal portion and integral guide rod 30-2 which is reciprocatably received in bore 14-5 so as to define a guide portion. Guide rod 30-2 is secured to clevis 40 and thereby strap 42 and crankshaft 44 in any suitable conventional manner. Annular upper terminal 22 is welded or otherwise suitably secured in a fluid tight manner to cylindrical portion 30-1 of piston 30 and to bellows 24.

Tubular portion or collar 14-3, lower terminal 18, the interior surface of bellows 24, upper terminal 22 and the interior of cylindrical portion 30-1 define a chamber 32 which is in fluid communication with the interior of crankcase 12 via bore 14-6 in crosshead 14. A second chamber 34 is defined by the exterior surface of bellows 24, lower terminal 18, upper terminal 22 and bore 14-2. Chamber 34 has a restricted communication across piston 30 via the clearance between cylindrical portion 30-1 and bore 14-2 and is in fluid communication via bore 14-7 with buffer chamber 50. Buffer chamber 50 is separated from buffer chamber 54 by diaphragm 52. Buffer chamber 54 is in communication with the interior of crankcase 12 via bore 12-1.

The regenerator 60, as best shown in FIG. 4, is integral with and located above heat exchanger or cooler 16 and includes cylinder 16-1 located in upper casing or shell 16-2 and cold head 62. The annular space between cylinder 16-1 and shell 16-2 is filled with wire screen or mesh 60-1 which functions as the regenerator. Cylinder 16-1 generally forms a continuation of bore 14-2 and receives piston head or dome 30-3 which is secured to piston 30 in any suitable manner so as to be integral therewith. Piston head or dome 30-3 is made of very thin stainless steel so as to have very low heat conduction. This results in reduced heat transfer between the cold gas passing into cylinder 16-1 and piston 30. The piston head or dome 30-3 has a larger clearance with cylinder 16-1 than does piston 30 and bore 14-2 since more radial movement of piston head or dome 30-3 is possible because of its greater distance from bore 14-5 which receives and guides the guide rod 30-2. Helium gas passing from compressor 131 via line 61 enters bore 16-3 in lower casing 16-4 and then passes into annular chamber 16-5. The helium gas passes from annular chamber 16-5 into capillary tubes 17 through screen or mesh 60-1 of regenerator 60 in upper casing 16-2 and over cold head 62. The annular space between cylinder 16-1 and upper casing 16-2 defines a portion of line 59 of FIG. 1. The helium gas is drawn into cylindrical portion 16-1 via line 59 by the suction stroke of piston 30 and its integral piston head or dome 30-3. During the discharge stroke the flow is reversed. Heat exchanger 16 further includes inlet port 16-6 and outlet port 16-7 which are connected via annular chamber 16-8 which surrounds the chamber containing capillary tubes 17. Therefore, when a suitable heat transfer medium is supplied to port 16-6, the capillary tubes 17 are cooled as is the gas flowing through tubes 17.

Figure 5:
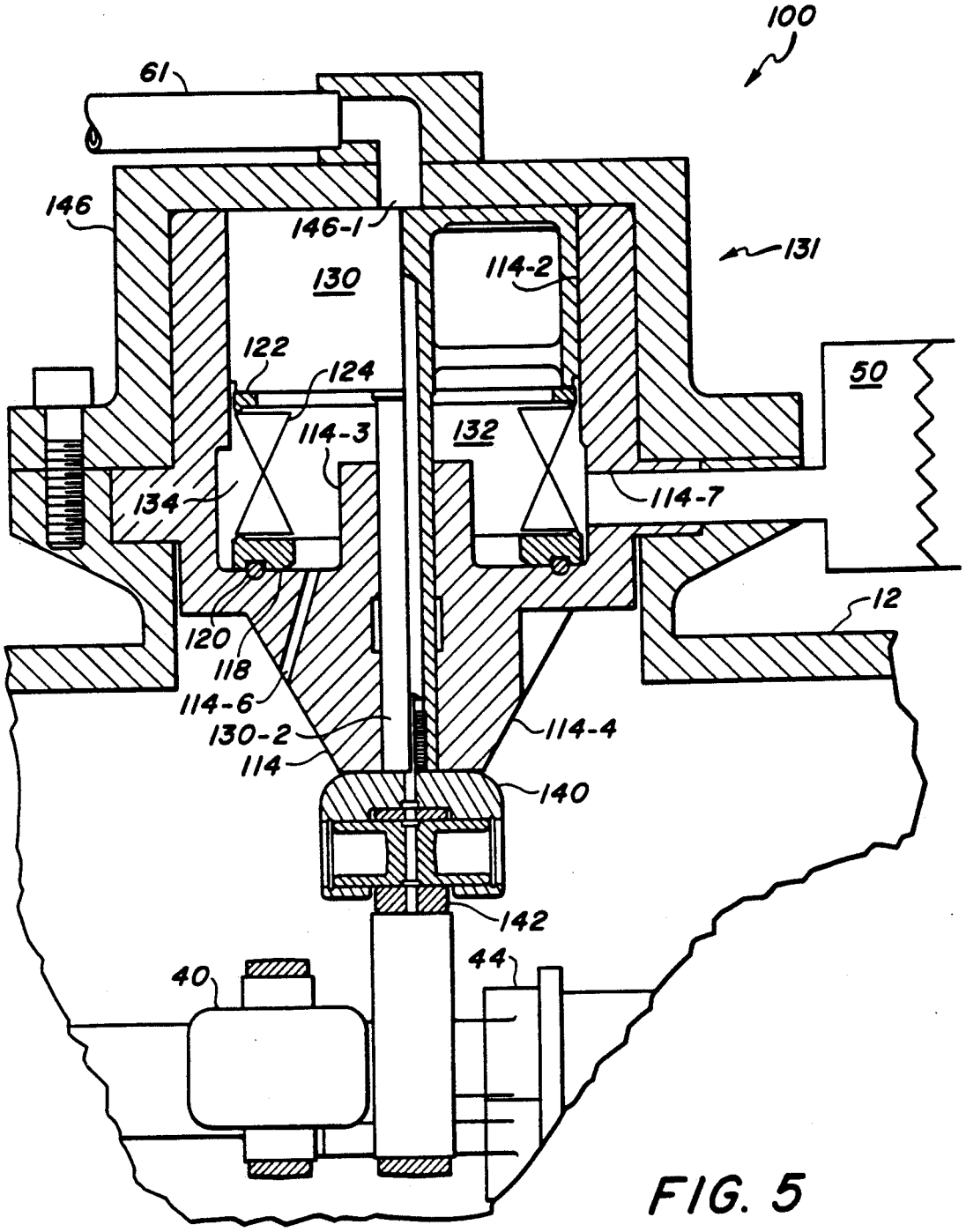
FIG. 5 is a partially sectioned view of the compressor in the top dead center position.

Compressor 131, as best shown in FIG. 5, is structurally similar to expander 31 and corresponding structure has been numbered 100 higher and is functionally similar to the corresponding structure of expander 31. Cover 146 is suitably secured to crankcase 12 and coacts with bore 114-2 of crosshead 114 to define the gas volume being compressed by piston 130. Cover 146 has a bore 146-1 connected to line 61. Bore 114-7 is connected to chamber 50. The coaction of piston 130 and bellows 124 is the same as that of piston 30 and bellows 24.

Figure 6:
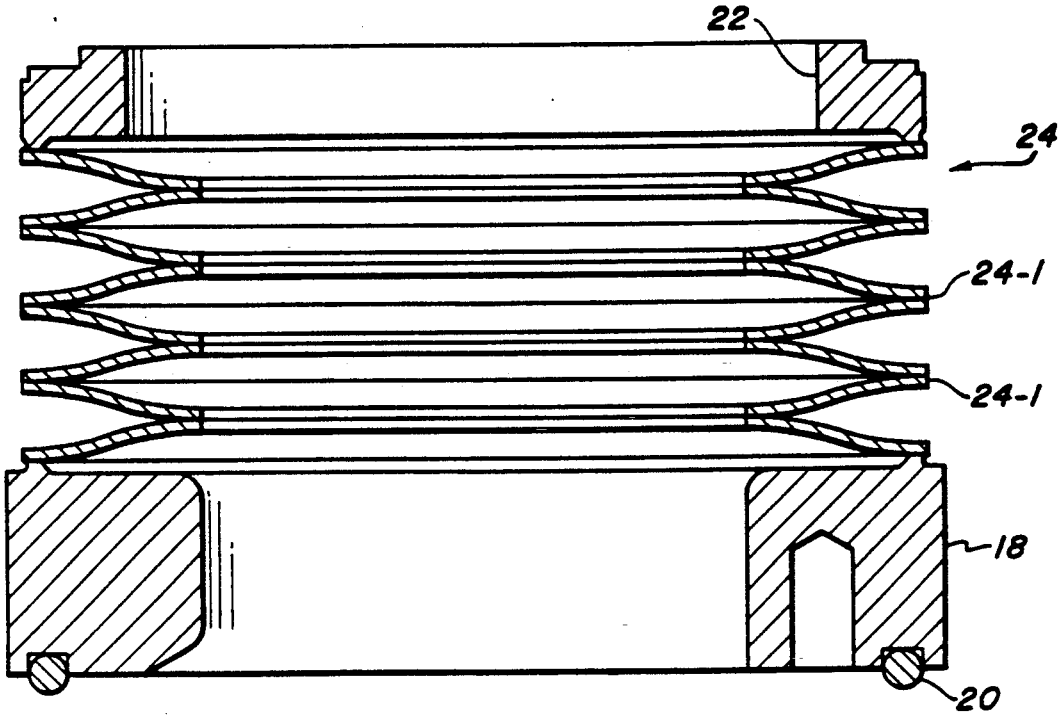
FIG. 6 is a sectional view of the bellows showing its attachment structure.

Referring now to FIG. 6, it will be noted that the bellows 24 is made up of a plurality of Bellville washer type or other suitable elements 24-1 which are welded together in a stack to form a fluid tight unit. Specifically, each intermediate element 24-1 is welded at its outer periphery to one adjacent element 24-1 and at its inner periphery to another adjacent element 24-1. The bottom element is welded to annular lower terminal 18 and the top element is welded to annular upper terminal 22. Bellows 124 is similarly constructed.

In operation, crankshaft 44 is rotated by a motor (not illustrated) which, in turn, drives strap 42 of the expander 31 and strap 142 of the compressor 131. Straps 42 and 142 are approximately 90° out of phase so that the piston 130 of the compressor 131 is driven approximately 90° ahead of piston 30. In comparing the top dead center position of FIG. 2 with the bottom dead center of FIG. 3, it will be noted that chambers 32 and 34 each have their greatest volumes in their FIG. 2 position and their smallest volumes in their FIG. 3 position. As a result, chambers 32 and 34 are, effectively, pumping volumes during the operation of the cryocooler 10. Starting with the FIG. 2 position of the device, chambers 32 and 34 are at a maximum, as noted. As piston 30 moves from the FIG. 2 position towards the FIG. 3 position, refrigerant gas in chamber 32 will return to crankcase 12 via bore 14-6 in crosshead 14. Additionally refrigerant gas from chamber 34 will be forced into buffer chamber 50 via bore 14-7 and will act on diaphragm 52 in opposition to the refrigerant in chamber 54 which is at crankcase pressure. Diaphragm 52 will be positioned responsive to the pressure differential between chambers 50 and 54 and will, therefore, in effect, act as a diaphragm pump. Because of the clearance seal formed by the small clearance between cylindrical portion 30-1 and bore 14-2 the pressure differential will normally be less than 10 psi. In further comparing FIGS. 2 and 3 it will be noted that cylindrical portion 30-1 of piston 30 is able to move to a position in which the axial spacing between tubular portion 14-3 and cylindrical portion 30-1 is minimal, or even negative, and the height/length of the assembly is thereby reduced by an amount corresponding to the height/length of the bellows. The foregoing description of expander 31 also applies to the corresponding structure of compressor 131 which is numbered 100 higher, as noted above.

Although a preferred embodiment of the present invention has been illustrated and described, other changes will occur to those skilled in the art. It is therefore intended that the scope of the present invention is to be limited only by the scope of the appended claims.

What is claimed is:

1. A fluid machine comprising:

housing means having a generally cylindrical piston bore formed therein and a guide bore coaxial with said piston bore;

said guide bore including a portion defined by an annular collar extending into said piston bore and coacting with said piston bore to define an annular space axially coextensive with said collar;

piston means having an annular cylindrical portion reciprocatably located in said piston bore and an integral guide rod with said guide rod being reciprocatably located in and coacting with said guide bore in a guided relationship and operatively connected to driving means for reciprocating said piston means;

said annular cylindrical portion of said piston means having a clearance with said piston bore such that contact does not take place therebetween during normal operation; and a bellows assembly at least partially located in said annular space surrounding said annular collar and having a first end secured and sealed to said housing means and a second end secured and sealed to said annular cylindrical portion whereby said bellows assembly expands and contracts due to reciprocating movement of said piston means and moves in a telescoping fashion with respect to said annular collar.

2. The fluid machine of claim 1 wherein said bellows assembly has a clearance with said piston bore such that as said bellows assembly expands and contracts in said piston bore there is no contact therebetween during normal operation.

3. The fluid machine of claim 1 wherein said bellows assembly includes an annular lower terminal secured to said housing means and an annular upper terminal secured to said annular cylindrical portion.

4. The fluid machine of claim 1 wherein said fluid machine is a Stirling cycle cryocooler and said housing means includes a crosshead which defines said guide bore and said annular collar.

5. A Stirling cycle cryocooler means comprising:

housing means including an expander means and a compressor means;

each of said expander means and said compressor means including:

(a) a generally cylindrical piston bore and a guide bore coaxial with said piston bore, (b) said guide bore including a portion defined by an annular collar extending into said piston bore and coacting with said piston bore to define an annular space axially coextensive with said collar, (c) piston means having an annular cylindrical portion reciprocatably located in said piston bore and an integral guide rod with said guide rod being reciprocatably located in and coacting with said guide bore in a guided relationship and operatively connected to driving means for reciprocating said piston means, (d) said annular cylindrical portion of said piston means having a clearance with said piston bore such that contact does not take place therebetween during normal operation, and (e) a bellows assembly at least partially located in said annular space surrounding said annular collar and having a first end secured and sealed to said housing means and a second end secured and sealed to said annular cylindrical portion whereby said bellows assembly expands and contracts due to reciprocating movement of said piston means and moves in a telescoping fashion with respect to said annular collar.

6. The Stirling cycle cryocooler means of claim 5 wherein said bellows assembly has a clearance with said piston bore such that as said bellows assembly expands and contracts in said piston bore there is no contact therebetween during normal operation.

7. The Stirling cycle cryocooler means of claim 5 wherein said bellows assembly includes an annular lower terminal secured to said housing means and an annular upper terminal secured to said annular cylindrical portion.

8. The Stirling cycle cryocooler means of claim 5 wherein each of said expander means and said compressor means further includes:

(f) a crosshead member forming a portion of said housing means and defining said guide bore, said annular collar, said annular space and said piston bore whereby said guide bore and piston bore are formed in the same member.

9. The Stirling cycle cryocooler means of claim 8 wherein said crosshead member further includes a tubular portion coacting with said annular collar to define said guide bore whereby said guide bore is provided with a sufficient length to minimize canting of said piston means.

* * * * *